US008234732B2

(12) United States Patent
Bacon

(10) Patent No.: US 8,234,732 B2
(45) Date of Patent: Aug. 7, 2012

(54) ORTHOPEDIC PILLOW

(76) Inventor: Paul Roland Bacon, Rye, NH (US)

( * ) Notice: Subject to any disclaimer, the term of this patent is extended or adjusted under 35 U.S.C. 154(b) by 0 days.

(21) Appl. No.: 13/224,627

(22) Filed: Sep. 2, 2011

(65) Prior Publication Data

US 2012/0054966 A1 Mar. 8, 2012

Related U.S. Application Data

(60) Provisional application No. 61/379,419, filed on Sep. 2, 2010.

(51) Int. Cl.
*A47G 9/10* (2006.01)

(52) U.S. Cl. ..... 5/636; 5/640; 5/657

(58) Field of Classification Search ..... 5/630, 636, 5/640, 645, 652, 655.9, 657, 639
See application file for complete search history.

(56) References Cited

U.S. PATENT DOCUMENTS 5,307,532 A * 5/1994 Connell ..... 5/643
5,360,017 A * 11/1994 Austin ..... 5/640
5,581,831 A * 12/1996 Xiang ..... 5/636
6,345,401 B1 * 2/2002 Frydman ..... 5/636
7,013,512 B1 * 3/2006 Hsu ..... 5/636
7,203,983 B1 * 4/2007 Reeves et al. ..... 5/636
7,578,015 B1 * 8/2009 Wilson et al. ..... 5/644
7,681,263 B1 * 3/2010 Hawkins ..... 5/640
8,037,562 B2 * 10/2011 Kemper et al. ..... 5/701
2005/0177944 A1 * 8/2005 Kang et al. ..... 5/636
2011/0056023 A1 * 3/2011 Weeks ..... 5/652
2011/0061166 A1 * 3/2011 Liu ..... 5/636
2011/0271453 A1 * 11/2011 Gandhi ..... 5/640

* cited by examiner

*Primary Examiner* — William Kelleher
(74) *Attorney, Agent, or Firm* — Mesmer & Deleault, PLLC

(57) ABSTRACT

An orthopedic pillow has a plurality of foam layers. The plurality of foam layers includes a top foam layer made of memory foam. The top foam layer is constructed and arranged to receive a user's head. The plurality of foam layers also includes a middle foam layer made of latex foam, the middle layer defining a central opening, and a bottom layer made of latex foam. The orthopedic pillow also has a high density foam tube affixed to an edge of the top foam layer. The high density foam tube is constructed and arranged to support the user's neck.

18 Claims, 7 Drawing Sheets

ORTHOPEDIC PILLOW

CROSS REFERENCE TO RELATED APPLICATIONS

This patent application claims the benefit of U.S. Provisional Patent Application No. 61/379,419 filed on Sep. 2, 2010, entitled, "Orthopedic Pillow", the contents and teachings of which are hereby incorporated by reference in their entirety.

BACKGROUND OF THE INVENTION

1. Field of the Invention

The present invention relates generally to pillows and specifically to pillows that provide ideal alignment for the head, neck, and spine for users when they sleep on their side.

2. Description of the Prior Art

For centuries, traditional pillows have been used to provide a cushion for the head during sleep. Traditional pillows include a fabric liner filled with a traditional cushioning (e.g., down, feathers, fiber, etc.). The traditional cushioning provides a level of comfort to a sleeper that is preferable to resting one's head directly on a bed or one's arm.

Recently, other types of pillows have become available that introduce geometries and materials not found in older feather or fiber pillows. For example, one newer type of pillow is a pillow formed entirely of memory foam. Some memory foam pillows are arranged in a dual lobe geometry, such as the NeckPillow by Tempur-Pedic™. Other memory foam pillows are contoured to the shape of the neck, such as the SidePillow by Tempur-Pedic®.

Other examples of pillows include water pillows and air pillows. One type of water pillow is the Mediflow™. Yet other examples of pillows include: butterfly neck pillows with fiber fill or memory foam, sleep apnea pillows, and contoured fiber filled pillows (e.g., Tri Core Cervical Support Neck Pillow).

SUMMARY OF THE INVENTION

Unfortunately, there are deficiencies to the above described traditional pillows. For example, traditional pillows can contribute to serious neck injuries and soft tissue damage by failing to support users in an ideal sleep posture and to provide proper structural support for the head and neck.

Feather pillows, for example, actually provide the human body with very little head and neck support at all. Down or feather fill is such a soft material that it immediately yields to the weight of the head (having typical weights of 10-14 lbs). When side sleeping on a down or feather pillow the head depresses the pillow tremendously, causing huge compression loads on the shoulder. When the head is not supported, the shoulder girdle becomes compacted, or crushed, resulting in forward or backward shoulder rolling. Sleeping in this position repeatedly can cause impairment to the lumbar spine, shoulder, and especially the cervical spine.

Fiber filled pillows appear to provide more structural support than feather pillows, as fiber is much firmer. However, fiber filled pillows do not provide cervical support, do not allow for proper distribution of load, and almost always result in side tilting of the head. Long term resting in this position can cause debilitating changes (e.g., lengthening and/or shortening) in the collagen tissue surrounding the cervical spine.

When back sleeping, both down and fiber filled pillows fail to provide support to the neck and cause chin tucking and forward head posture, especially if there is too much lift. Lack of cervical support, chin tucking, and forward head posture result in the flattening of the cervical spine, thoracic spine, and reciprocally, the lumbar spine. This position also places stress on the visco-elastic collagen tissue resulting in unfavorable changes similar to those incurred during side-sleeping.

Pillows made entirely of memory foam, are not successful in providing adequate support to the user simply because this material is not dense enough or firm enough to support the weight of the head and neck. Therefore, the shoulder and not the pillow bears the brunt of the load. Rather than support proper postural alignment, memory foam is designed to mold to the body. In effect, it yields to the body in excess, thereby supporting distorted spine and posture patterns. Dual-lobe memory foam pillows such as The NeckPillow by Tempur-Pedic™, like other types of memory foam pillows, do not properly support the head and neck, and the result is usually forward or lateral head tilt and chin tucking. Memory foam pillows with contoured neck support such as The SidePillow by Tempur-Pedic® are not high enough for head support and not dense enough to decompress the shoulder.

Water pillows come close to supporting the head properly and perform better than memory foam pillows in shoulder decompression, but water pillows leave the neck totally unsupported and promote lateral head tilt and shoulder rolling when side-sleeping. Back sleeping on the water pillow can cause great harm, as it provides no cervical support, thereby promoting chin tucking, forward head posture, and head rotation which results in damage to the cervical and lumbar spine.

Air pillows provide for more support to the cervical spine than other designs and do a fair job in properly supporting the head and decompressing the shoulder girdle. However, the displacement characteristics of the air in the pillow become uncomfortable to the user after a period of time. This is because, as the air is displaced when the user's head lowered onto the pillow, it has a nice gentle yield, but this yield subsequently reaches a sudden end point, giving a sensation of hardness against the user's head, or face.

Butterfly neck pillows with fiber fill or memory foam, when side-sleeping, fiber always either yields too much to the weight of the head, causing downward lateral head tilt, or the weight of the head displaces the fabric in such a way as to cause upward lateral head tilt. When back-sleeping the properties of fabric pillows allow for chin tucking or chin extension, head rotation, or forward head posture.

The sleep apnea pillow does not provide neck support, is not high enough to decompress the shoulder properly, accommodates abnormal shoulder positions, and encourages stomach sleeping with head rotation. A center slot in the sleep apnea pillow is designed to accommodate a sleeper's upward extended arm which causes the sleeper to counter-rotate the shoulder girdle in relationship to the head. This counter-rotation causes severe head rotation and a high/low shoulder postural configuration that is devastating for ideal spine and posture. Thus the sleep apnea pillow encourages contorted positions of the body (i.e., asymmetric positions and the misalignment of the head in relation to the torso) that are damaging to the spine.

The tri core cervical support pillow does not provide nearly enough cervical support for side-sleeping, nor is it dense enough or thick enough to support the head and shoulder girdle properly. The height of the pillow is not high enough to un-weight the shoulder girdle and does not accommodate for the weight of the head. This pillow is adequate for back sleeping. However, spinal biomechanical research, as well as sleep studies, shows that back sleeping is not an ideal sleep position. Back sleeping obstructs the airway passages and sleeping in this position exacerbates many conditions, such as snoring and sleep apnea. Spinal biomechanical research also shows that back sleeping does not provide appropriate support to the lumbar spine even if there is good cervical support. For these reasons, it is not advisable to sleep on one's back.

Another deficiency with traditional pillows marketed as supporting multiple sleeping positions (e.g., back sleeping, side sleeping, stomach sleeping, etc.) is that in attempting to accommodate different sleeping positions, they fail to properly support any one particular position adequately. Traditional pillows that are marketed as being designed for both side-sleeping and back-sleeping fail in meeting the requirements to structurally support the user in both positions because the extremes in requirements are too great. Since ideal support characteristics for alternative sleeping positions are often in conflict, one cannot accommodate both sleeping positions with the same design, without sacrificing some of the essential components required to support the body properly.

In contrast to the above described traditional pillows, an improved orthopedic pillow that provides proper structural support for side sleeping is firm enough to support the weight of the head, high enough to un-weight the shoulder girdle, and structured in such a way as to also support the neck and chin in proper alignment with the body.

For example, one embodiment is directed to an orthopedic pillow. The orthopedic pillow has a plurality of foam layers. The plurality of foam layers includes a top foam layer defining a top layer first surface and a top layer second surface, the top foam layer constructed and arranged to receive a user's head at the top layer first surface. The plurality of foam layers also includes at least one middle foam layer, each of the at least one the middle foam layer defining a middle layer first surface and a middle layer second surface, each middle layer first surface of the at least one middle foam layer being constructed and arranged to removably attach to one of (i) the top layer second surface and (ii) the middle layer second surface of another middle foam layer of the at least one middle foam layer. The plurality of foam layers also includes a bottom foam layer defining a bottom layer first surface and a bottom layer second surface, the bottom layer first surface constructed and arranged to removably attach to the middle layer second surface of one of the at least one middle foam layer. The orthopedic pillow also has a foam tube affixed to the top foam layer and one of the at least one middle foam layer, the foam tube constructed and arranged to support the user's neck

DETAILED DESCRIPTION OF THE PREFERRED EMBODIMENT

The preferred embodiment(s) of the present invention is illustrated in FIGS. 1-7.

Figure 1:
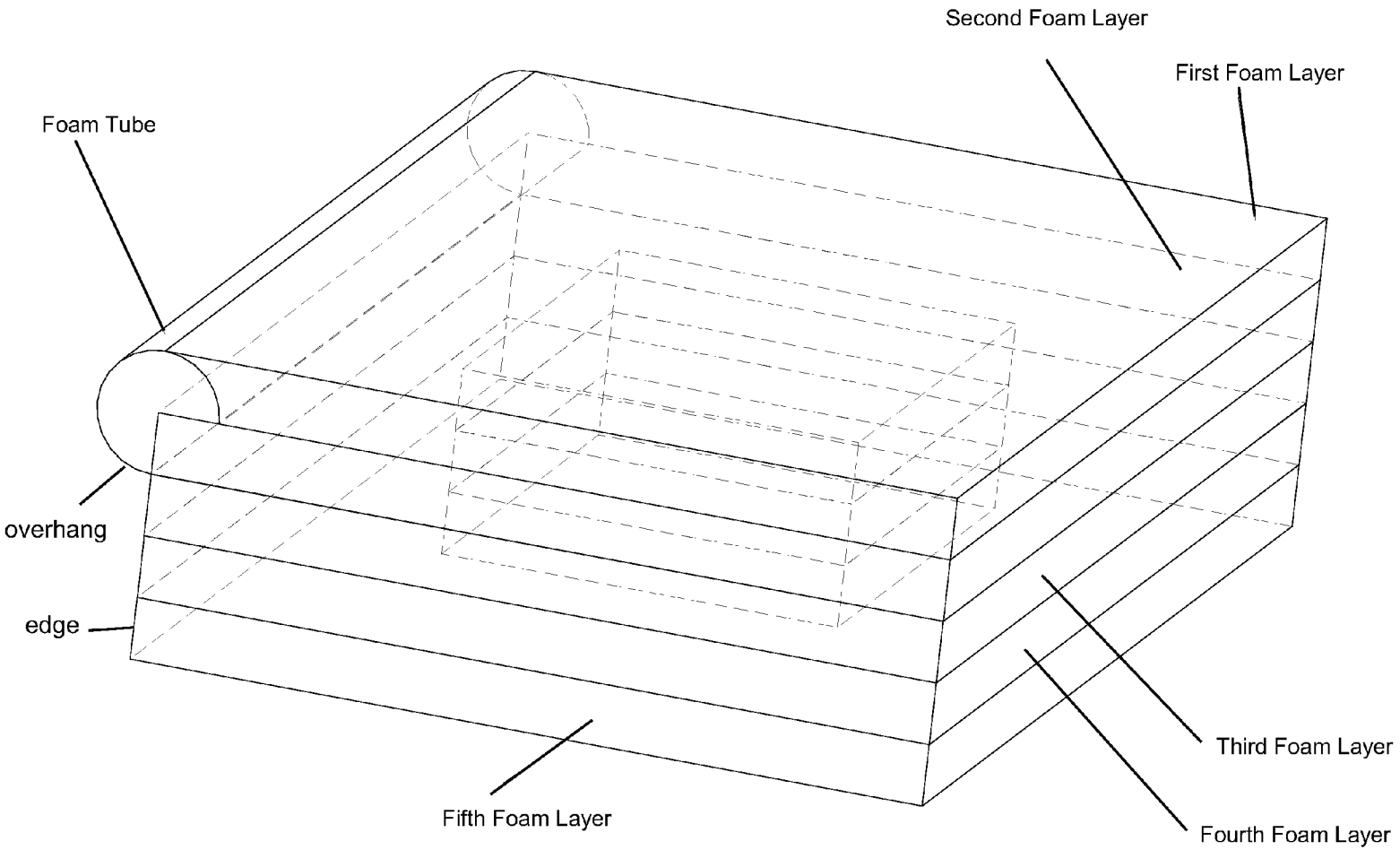
FIG. 1 is a perspective view of an orthopedic pillow having a plurality of foam layers and a foam tube.

FIG. 1 shows an orthopedic pillow. The orthopedic pillow includes a plurality of foam layers (i.e., one or more foam layers) and a foam tube.

In some arrangements, such as seen in FIG. 1, the plurality of foam layers includes five foam layers of varying composition and density stacked on top of each other. The pillow is high enough to un-weight the shoulder girdle. In somearrangements the height of the orthopedic pillow is approximately five inches. The length and width of the orthopedic pillow is sized to accommodate various bed sizes (e.g., twin, queen, king, etc.). In some arrangements, the length and width of the orthopedic pillow are respectively thirteen inches and twenty inches. The foam tube attaches to one or more top layers of the plurality of layers for cervical support. As shown in FIG. 1, a portion of the foam tube extends from the edge of the top foam layer and the edge the middle foam layer. The portion of the foam tube extends below the top foam layer and overhangs the bottom foam layer to define a space between the overhanging portion of the foam tube and the edge of the bottom layer. This defined space accepts the user's shoulder.

Any suitable methods for attaching the plurality of foam layers together may be used. For example, adhesives such as glue may be used to attach adjacent layers to each other. In some arrangements, it may be desirable to add or remove layers from the plurality of foam layers to adjust the height and comfort level of the orthopedic pillow to a specific user. Accordingly, in some arrangements, the layers are attached to each other in a non-permanent and replaceable manner. For example, a quilted, contoured pillow case that follows the curves of the foam tube and keeps a certain number of the foam layers securely in place may be used non-permanently attach the layers to each other. Other non-permanent attaching methods, such as velcro, may also be used.

Figure 2:
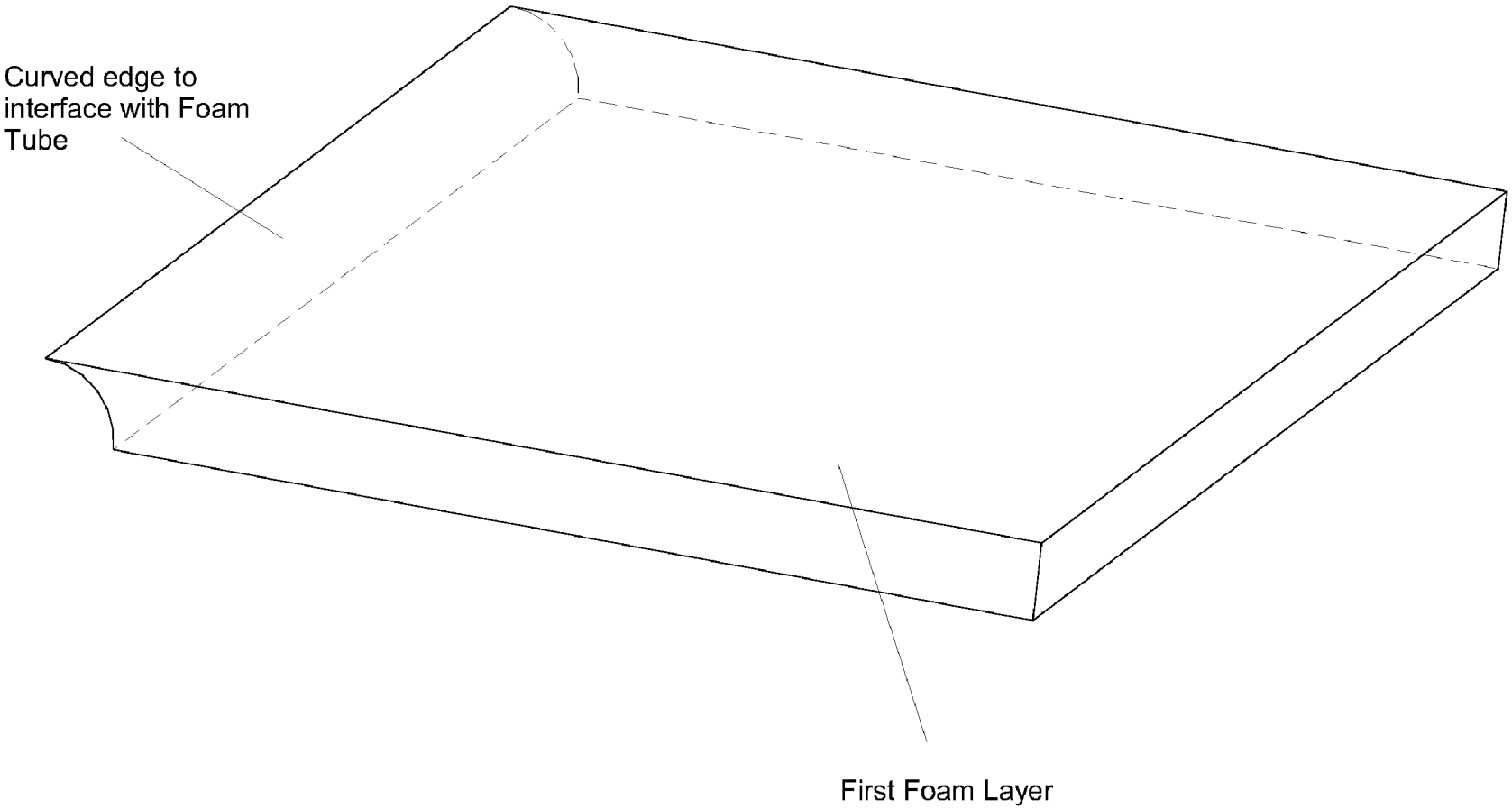
FIG. 2 is a perspective view of a first foam layer of the plurality of foam layers of FIG. 1.

FIG. 2 shows a first foam layer configured to be the topmost layer of the plurality of foam layers. The first foam layer is constructed and arranged to interface with a user's head during sleep. As the head interfacing layer, the first foam layer is made of a material that will comfortably accept and conform to the shape the user's head. For example, in some arrangements, the first foam layer is a piece of memory foam that is one inch thick, twenty inches long, and twelve inches wide. The first foam layer attaches directly to the foam tube, and in some arrangements, the edge of the length of the first layer is rounded to conform to the shape of the foam tube. In other arrangements, the edge of the length of the first layer is not rounded, and the foam material of the first foam layer deforms to conform to the shape of the foam tube.

Figure 3:
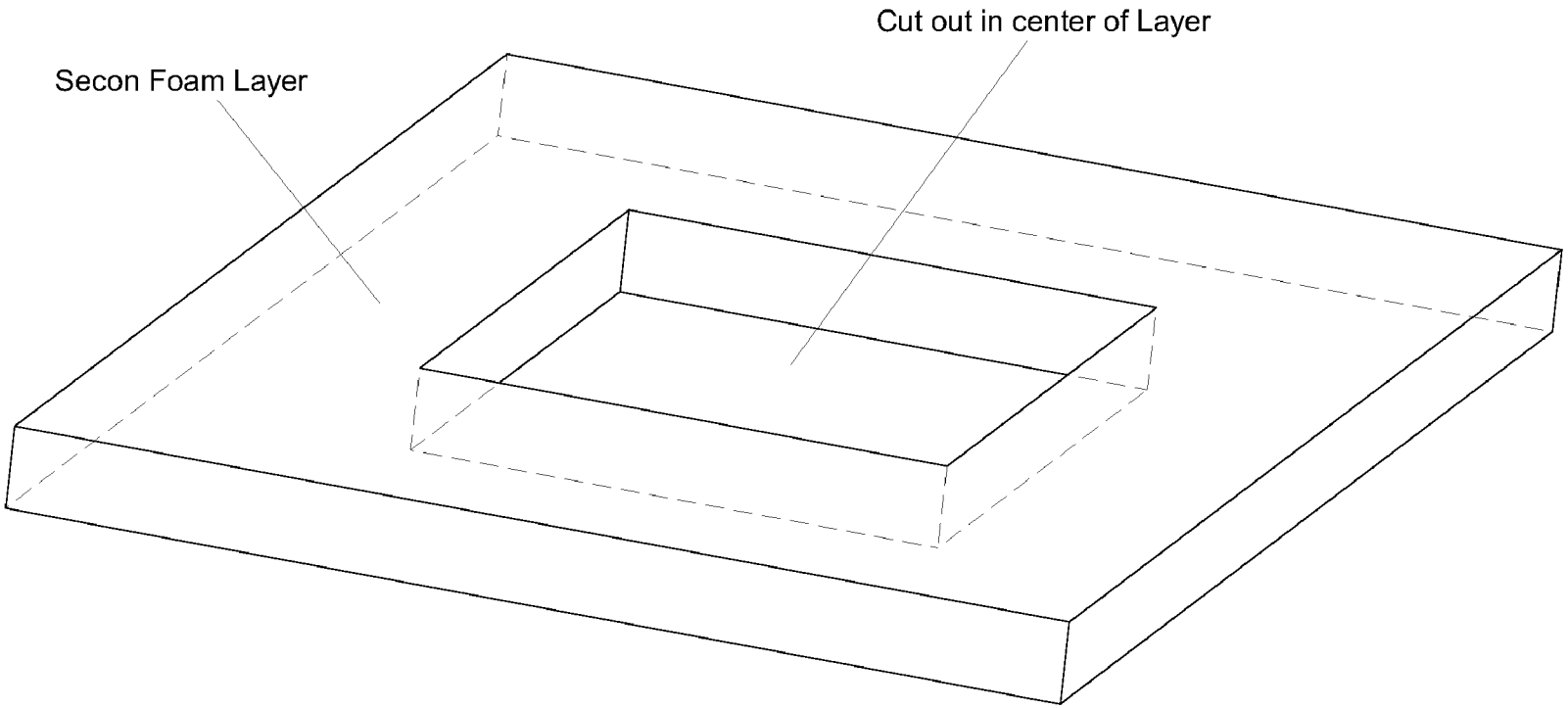
FIG. 3 is a perspective view of a second foam layer of the plurality of foam layers of FIG. 1.

FIG. 3 shows a second foam layer that is configured to be positioned directly underneath the first foam layer. Due to the proximity of the second foam layer to the user's head, the second foam layer is made from a material that will comfortably cushion the user's head. For example, in some arrangements, the second foam layer is made of memory foam. For added comfort, a central portion of the second foam layer is removed. For example, in some arrangements, the second foam layer is one inch thick, twenty inches long, twelve inches wide, and has a 6½-inch by 8½-inch rectangle removed from the center of the foam. An edge of the second foam layer attaches directly to the foam tube.

Figure 4:
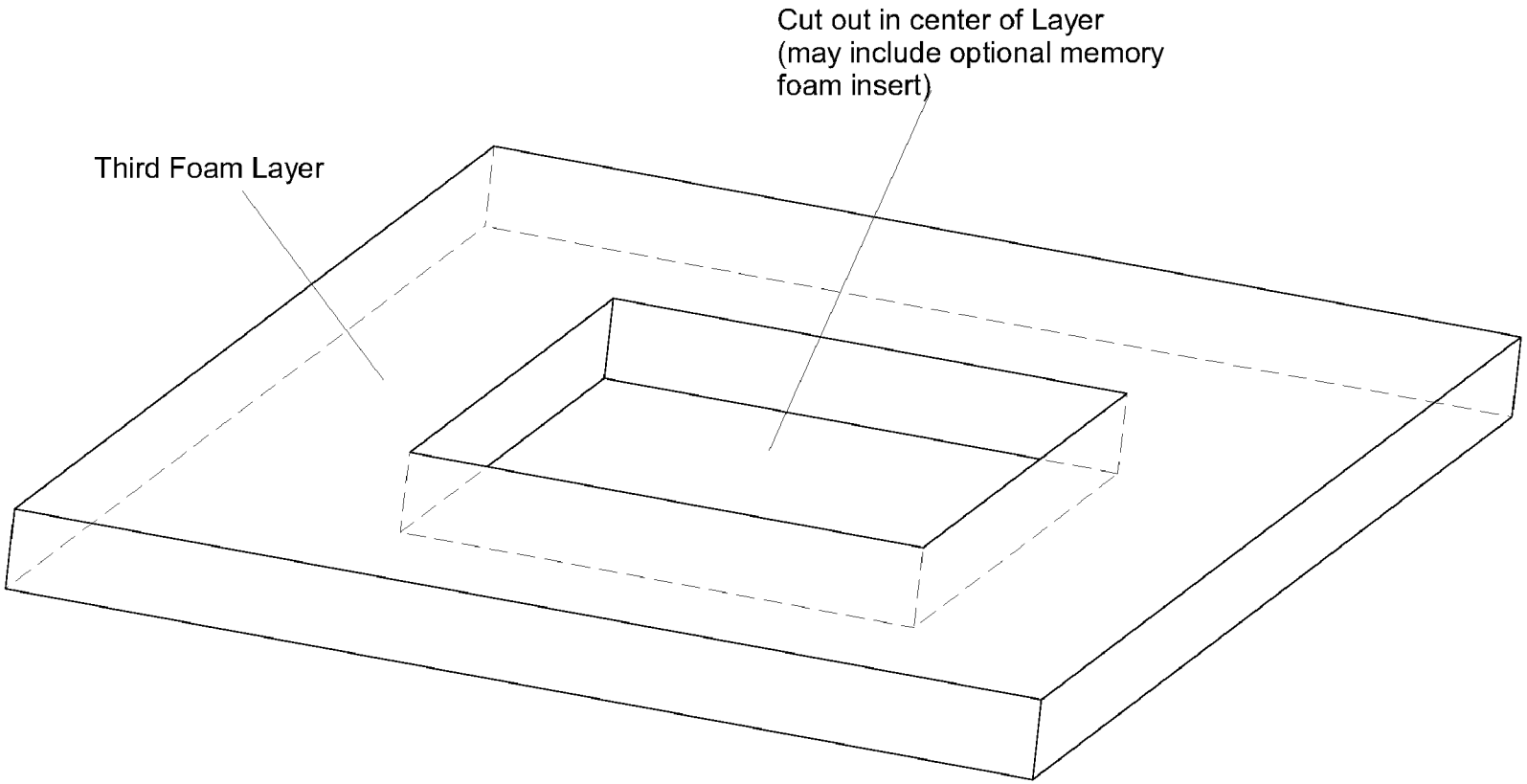
FIG. 4 is a perspective view of a third foam layer of the plurality of foam layers of FIG. 1.

FIG. 4 shows a third foam layer that is configured to be positioned directly underneath the second foam layer. The third foam layer is made of a material that is rigid enough to support the weight of the head adequately at a height that un-weights the shoulder girdle. For example, in some arrangements, the third foam layer is made of latex foam (e.g., medium density latex foam). For added comfort, a central portion of the third foam layer is removed and an optional cushioning is inserted into the central portion of the third foam layer. For example, in some arrangements, the third foam layer is one inch thick, twenty inches long, twelve inches wide, and has a 6½-inch by 8½-inch rectangle removed from the center of the foam to accommodate an optional 6½-inch by 8½-inch piece of memory foam.

Figure 5:
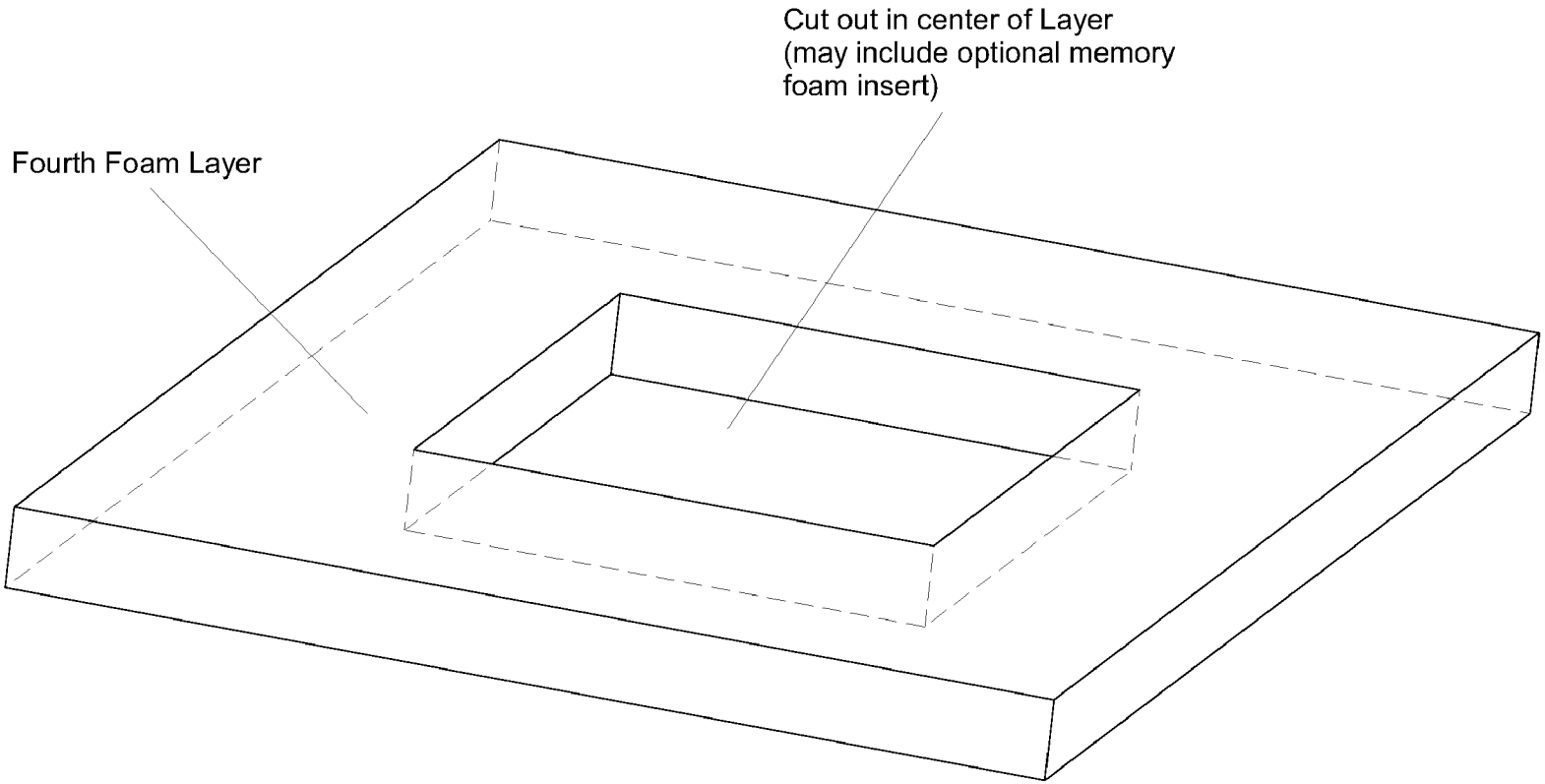
FIG. 5 is a perspective view of a fourth foam layer of the plurality of foam layers of FIG. 1.

FIG. 5 shows a fourth foam layer that is configured to be positioned directly underneath the third foam layer. The fourth foam layer is substantially similar to the third foam layer. The fourth foam layer is made of a material that is rigid enough to support the weight of the head adequately at a height that un-weights the shoulder girdle. For example, in some arrangements, the fourth foam layer is made of latex foam (e.g., medium density latex foam). For added comfort, a central portion of the fourth foam layer is removed and an optional cushioning is inserted into the central portion of the fourth foam layer. For example, in some arrangements, the fourth foam layer is one inch thick, twenty inches long, twelve inches wide, and has a 6½-inch by 8½-inch rectangle removed from the center of the foam to accommodate an optional 6½-inch by 8½-inch piece of memory foam.

Figure 6:
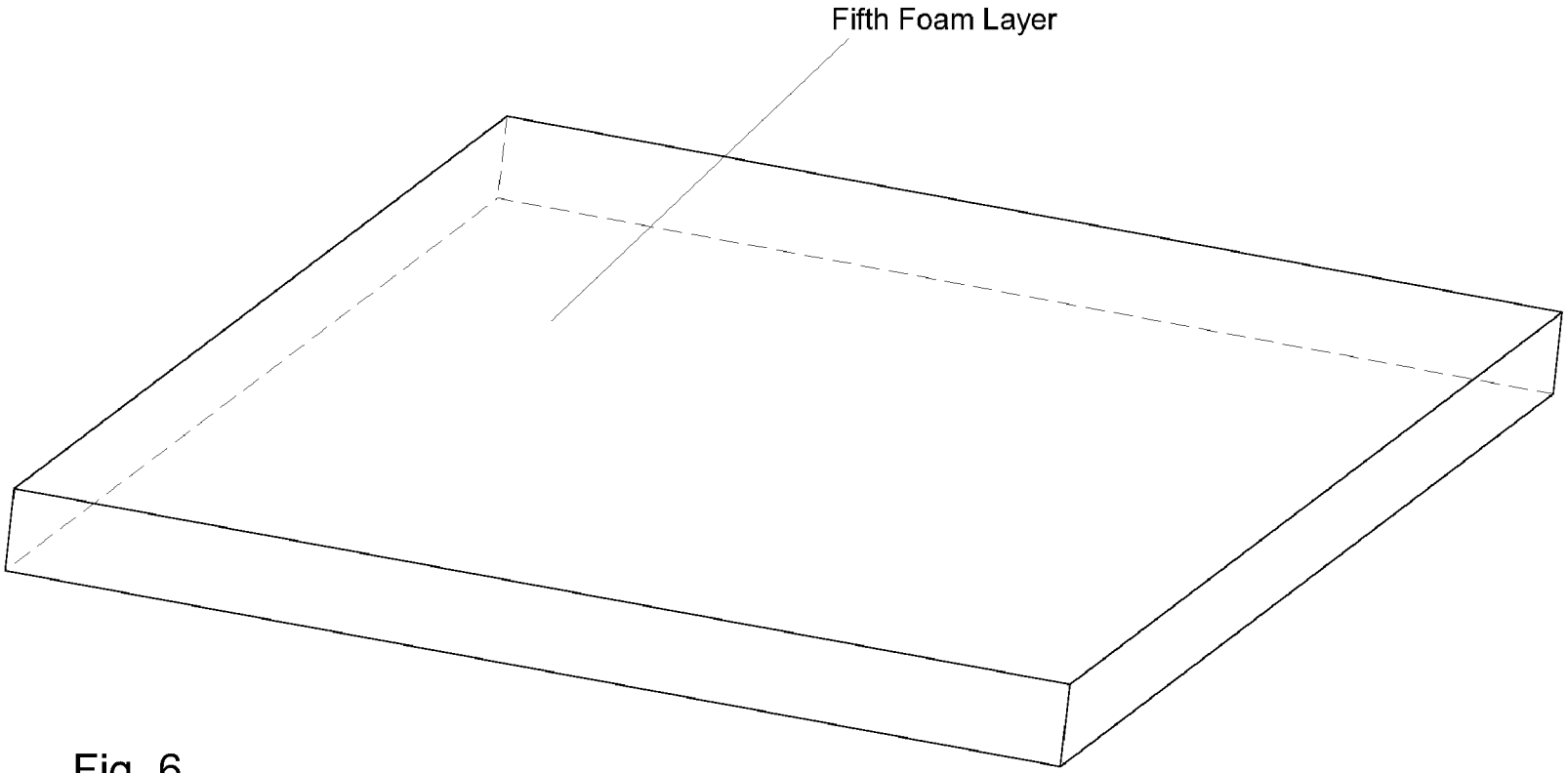
FIG. 6 is a perspective view of a fifth foam layer of the plurality of foam layers of FIG. 1.

FIG. 6 shows a fifth foam layer that is configured to be the bottommost layer of the plurality of layers and is positioned directly underneath the fourth foam layer. The fifth foam layer is made of a material that is rigid enough to support the weight of the head adequately at a height that un-weights the shoulder girdle. For example, in some arrangements, the fifth foam layer is of the pillow is a solid piece of latex foam (e.g., medium density latex foam) that is one inch thick, twenty inches long, and twelve inches wide.

Figure 7:
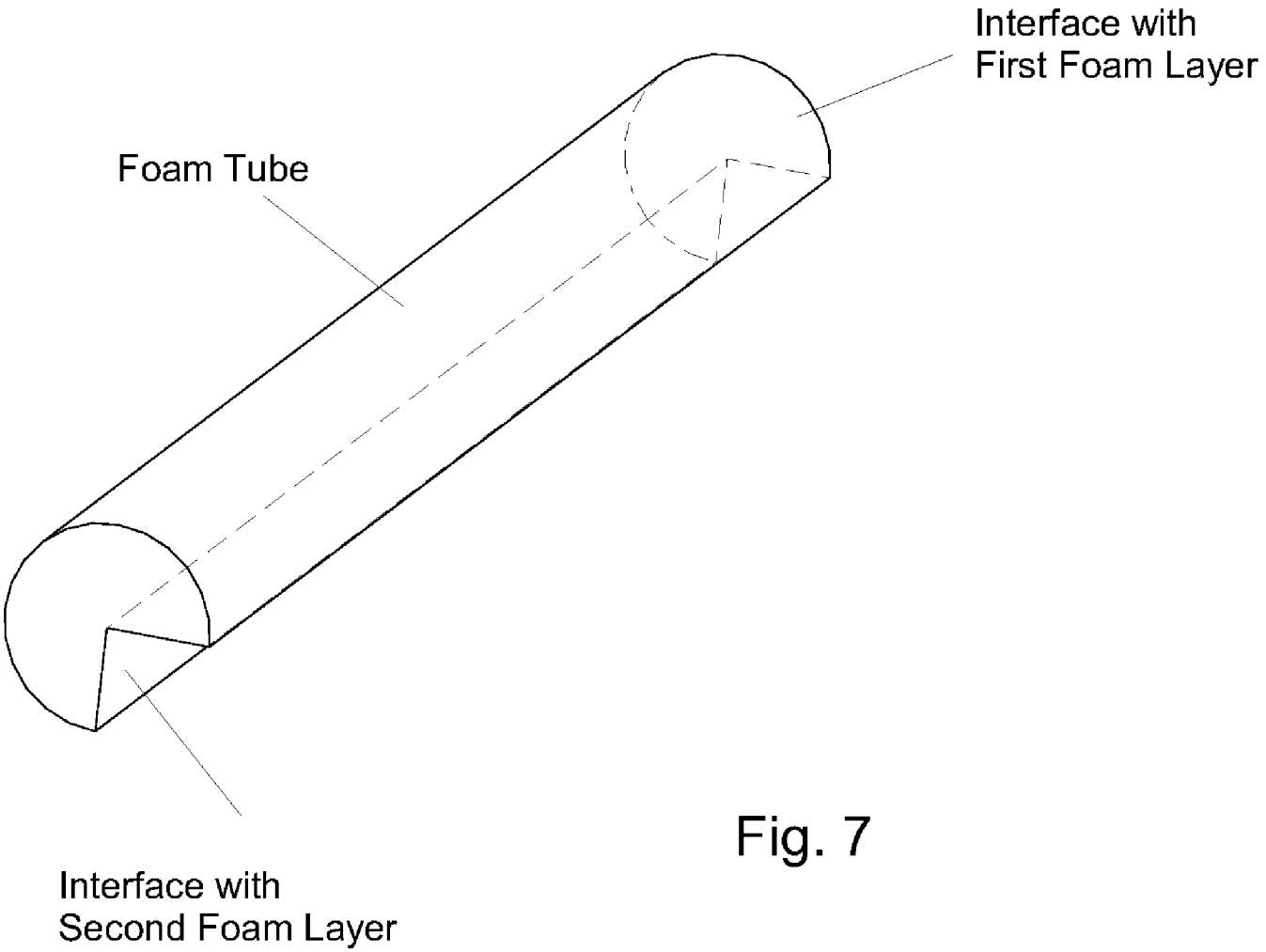
FIG. 7 is a perspective view of the foam tube of FIG. 1.

FIG. 7 shows the foam tube that attaches to the first foam layer and the second foam layer. The foam tube is made of a material that that is rigid enough to support the neck at a higher elevation than the head-to-pillow contact point. For example, in some arrangements, the foam tube is a twenty-inch long cylinder shaped piece of firm density foam having a quarter portion removed, so that there is a one inch wedge missing along the length of the cylinder. As seen in FIG. 1, two surfaces of the cylinder wedge attach directly (e.g., glue to) the second foam layer, and an outer rounded surface of the cylinder attaches directly (e.g., glue to) the first foam layer.

The multi-layer plus foam tube design of the orthopedic pillow provides ideal support for side-sleeping. Side sleeping is preferable to other sleeping positions because, as research reveals, side sleeping is the optimum sleeping position in terms of both spinal support and maintaining unobstructed breathing passages. The National Institute of Health recommends side sleeping in order to alleviate many major sleep disorders. Described below are mechanisms for how the orthopedic pillow provides ideal support for side sleeping.

The orthopedic pillow un-weights the shoulder girdle. Too much weight on the shoulder girdle is what causes one to roll the shoulder forward or backward in attempts to unload the shoulder and still maintain head support. People often feel stress on the shoulder during sleep, causing them to shift into contorted and misaligned sleeping postures when trying for a more comfortable position. The orthopedic pillow lightens the load placed on the shoulder when side-sleeping, by providing a vertical rise proximal to the top of the shoulder which is both higher and firmer than other pillow models. Fiber fill, down fill, water fill, or memory foam alone does not provide enough support to accomplish this unyielding vertical rise. By un-weighting the shoulder girdle, the orthopedic pillow helps the user to avoid injury to the spine and shoulder. Unnatural or unbalanced loading promotes degenerative changes in the spine.

The orthopedic pillow properly supports both the head and neck. The foam tube that is attached to the top layers of the pillow provides a rounded edge that makes this part of the pillow slightly higher in order to support the neck, which is narrower then the head. This rounded edge also encourages proper neck position while side lying. The orthopedic pillow is made with three layers of latex and two layers of memory foam. The latex is a very firm and supportive material which will provide long lasting support of the weight of the head. Traditional pillows are actually not firm enough to support this 10-15 pound weight, often resulting in a sleeper tucking the chin downward for additional support and/or comfort. The latex material used in the orthopedic pillow additionally prevents the head from sinking into the material and potentially obstructing the nasal passages. The top two layers of memory foam provide the soft comfort which is generally desired in a pillow. Thus, the orthopedic pillow is both soft enough to be comfortable, yet dense enough to support the weight of the head.

The Orthopedic pillow prevents tucking, extending, or projecting of the chin. The foam tube creates a built-up edge that also prevents the user from tucking the chin downward, extending the chin upward, or projecting the chin forward. Chin flexion and extension adversely affect breathing and compromise the spine and posture. Over time, this motion may also result in a loss of curve in the neck, potentially causing pain and decreased range of motion in the neck. Additionally, neck flexion causes a compression load on the front of the cervical joints. Over time this load may result in degenerative changes to the spine, such as arthritic spurring.

An additional feature of the orthopedic pillow that prevents tucking, extending, or projecting of the chin is the removed central portion from one or more of the central foam layers. For example, in one arrangement, because a 6½×8½ rectangle is removed from the center of the second foam layer of the orthopedic pillow, making the center of the pillow only 4 layers deep, a shallow head-sized cavity is created which also gently prohibits the chin and head from extending beyond the boundaries of this area.

The orthopedic pillow cradles the head in order to provide comfort to the face and decompression of the ears. The shallow cavity in the center of the orthopedic pillow is concave and cradles the head, face, and ears, with two layers of memory foam (note that the third foam layer of latex has a memory foam rectangle inserted into the center cut-out area, allowing for more cushion to the face). This soft concave area removes pressure from the ear, which commonly causes people discomfort when they are using a firm traditional pillow such as the water or air pillow.

The orthopedic pillow maintains neutral head posture in proper alignment with the torso. The concave shallow cavity, along with the raised tubular neck supporting edge, work together in a profound way to keep the neck straight and in proper linear alignment with the body. A straight neck is much more rigid, therefore less likely to buckle, tuck, or extend and cause more discomfort and twisting of the shoulders while attempting to regain stability and comfort. A straight neck, absence of forward head translation, rotation, and lateral tilt, as well as absence of extension, flexion and chin tucking are indicators of the neutral head posture required to keep the head aligned with the torso. The un-weighting of the shoulder girdle further aids in maintaining alignment of the entire spine.

The maintenance of neutral head posture in proper alignment with the torso is essential to healthy sleep, as research indicates that maintaining an improper posture for more than 7-10 minutes, especially in a resting position, can cause the shortening or lengthening of the collagen tissue, which cannot be restored without physical rehabilitative therapy. These changes to the collagen tissue can be debilitating over time.

The orthopedic pillow is adjustable to accommodate all users. People come in a wide range of shapes and sizes and thus no single pillow thickness provides the ideal height to support the head and neck for everyone. The thickness of the orthopedic pillow is adjustable to provide ideal support for users of all sizes. Layers can be added or removed to adjust the overall height orthopedic pillow to an ideal level that ensures proper un-weighting of the girdle. Additionally, removable central pieces of foam may be stacked to the desired height in the central cavity of the orthopedic pillow for comfort.

Many traditional pillows are made from materials that break down over time. The orthopedic pillow is constructed to last for many years. In particular, the latex foam that provides much of the structural support of the orthopedic pillow is a material that is very durable and will last a long time.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An orthopedic pillow comprising:

a plurality of foam layers including:

a top foam layer defining a top layer first surface and a top layer second surface, the top foam layer constructed and arranged to receive a user's head at the top layer first surface, at least one middle foam layer, the at least one the middle foam layer defining a middle layer first surface and a middle layer second surface, the middle layer first surface being constructed and arranged to removably attach to one of (i) the top layer second surface and (ii) the middle layer second surface of another middle foam layer of the at least one middle foam layer, and a bottom foam layer defining a bottom layer first surface and a bottom layer second surface, the bottom layer first surface constructed and arranged to removably attach to the middle layer second surface of one of the at least one middle foam layer; and a foam tube affixed to the top foam layer and the at least one middle foam layer, wherein a portion of the foam tube extends from an edge of the top foam layer and an edge of the at least one middle foam layer, the foam tube constructed and arranged to support the user's neck;

wherein the portion of the foam tube extends below the top foam layer and overhangs the bottom foam layer thereby defining a space between the portion of the foam tube and an edge of the bottom layer to accept the user's shoulder;

wherein the at least one middle foam layer defines a central opening, the central opening separated from the foam tube by a portion of the at least one middle foam layer extending a pre-defined distance towards the foam tube.

2. The orthopedic pillow of claim 1:

wherein the top foam layer is made of foam having a first density;

wherein the at least one middle foam layer and the bottom foam layer are made of foam having a second density;

wherein the foam tube is made of foam having a third density;

wherein the third density is greater than the second density and the second density is greater than the first density.

3. The orthopedic pillow of claim 2, wherein the top foam layer is made of memory foam;

wherein the at least one middle foam layer, the bottom foam layer, and the foam tube are made of latex foam.

4. The orthopedic pillow of claim 1, further comprising one or more additional middle foam layers positioned between the at least one middle foam layer and the bottom foam layer, wherein each of the one or more additional middle foam layers has a central opening with a removable foam insert that aligns with the central opening of the at least one middle foam layer.

5. The orthopedic pillow of claim 4, wherein the removable foam insert is substantially the same size as the central opening of the at least one middle foam layer.

6. The orthopedic pillow of claim 5, wherein the removable foam insert and the one or more additional middle foam layers are made of identical material and have identical density.

7. The orthopedic pillow of claim 1, further comprising a resealable pillow case shaped to match the plurality of foam layers and the foam tube, the reseal able pillow case constructed and arranged to removably attach the plurality of foam layers to each other.

8. The orthopedic pillow of claim 1, wherein the plurality of foam layers removably attach to each other with hook and loop fasteners.

9. The orthopedic pillow of claim 1:

wherein the foam tube is a cylinder defining a quarter sector mounting slot;

wherein the quarter sector mounting slot permanently attaches to a corner edge of one of the at least one middle foam layers;

wherein the top layer foam layer defines a top side surface, the top side surfaces contoured to match a quarter arc of the foam tube cylinder.

10. An orthopedic pillow kit comprising:

a top foam layer defining a top layer first surface and a top layer second surface, the top foam layer constructed and arranged to receive a user's head at the top layer first surface;

at least one middle foam layer, the at least one the middle foam layer defining a middle layer first surface and a middle layer second surface, each middle layer first surface of the at least one middle foam layer being constructed and arranged to removably attach to one of (i) the top layer second surface and (ii) the middle layer second surface of another middle foam layer of the at least one middle foam layer; and a bottom foam layer defining a bottom layer first surface and a bottom layer second surface, the bottom layer first surface constructed and arranged to removably attach to the middle layer second surface of one of the at least one middle foam layer;

wherein one of the at least one middle foam layer includes a foam tube constructed and arranged to support the user's neck, the foam tube extending from an edge of the at least one middle foam layer;

wherein a portion of the foam tube is constructed and arranged to extend below the top foam layer and overhang the bottom foam layer to define a space between the portion of the foam tube and an edge of the bottom layer for accepting the user's shoulder;

wherein the at least one middle foam layer defines a central opening, the central opening separated from the foam tube by a portion of the at least one middle foam layer extending a pre-defined distance towards the foam tube.

11. The orthopedic pillow kit of claim 10:

wherein the top foam layer is made of foam having a first density;

wherein the at least one middle foam layer and the bottom foam layer are made of foam having a second density;

wherein the foam tube is made of foam having a third density;

wherein the third density is greater than the second density and the second density is greater than the first density.

12. The orthopedic pillow kit of claim 11, wherein the top foam layer is made of memory foam; wherein the at least one middle foam layer, the bottom foam layer, and the foam tube are made of latex foam.

13. The orthopedic pillow kit of claim 10, further comprising one or more additional middle foam layers for positioning between the at least one middle foam layer and the bottom foam layer, wherein each of the one or more additional middle foam layer has a central opening with a removable foam insert that aligns with the central opening of the at least one middle foam layer.

14. The orthopedic pillow kit of claim 13, wherein the removable foam insert is substantially the same size as the central opening of the at least one middle foam layer.

15. The orthopedic pillow kit of claim 14, wherein the at least one removable foam insert and the one or more additional middle foam layers are made of identical material and have identical density.

16. The orthopedic pillow kit of claim 10, further comprising a reseal able pillow case shaped to match the plurality of foam layers and the foam tube, the reseal able pillow case constructed and arranged to removably attach the plurality of foam layers to each other.

17. The orthopedic pillow kit of claim 10, wherein the plurality of foam layers removably attach to each other with hook and loop fasteners.

18. The orthopedic pillow kit of claim 10:

wherein the foam tube is a cylinder defining a quarter sector mounting slot;

wherein the quarter sector mounting slot permanently attaches to a corner edge of one of the at least one middle foam layers;

wherein the top layer foam layer defines a top side surface, the top side surfaces contoured to match a quarter arc of the foam tube cylinder.

* * * * *